US009061408B2

(12) United States Patent
Ishizawa et al.

(10) Patent No.: US 9,061,408 B2
(45) Date of Patent: Jun. 23, 2015

(54) FASTENER DRIVING TOOL

(75) Inventors: Yoshinori Ishizawa, Ibaraki (JP); Haruhiko Oouchi, Ibaraki (JP); Yoshimitsu Iijima, Ibaraki (JP)

(73) Assignee: HITACHI KOKI CO., LTD., Tokyo (JP)

( * ) Notice: Subject to any disclaimer, the term of this patent is extended or adjusted under 35 U.S.C. 154(b) by 624 days.

(21) Appl. No.: 13/302,666

(22) Filed: Nov. 22, 2011

(65) Prior Publication Data

US 2012/0298712 A1 Nov. 29, 2012

(30) Foreign Application Priority Data

Nov. 26, 2010 (JP) ..... 2010-263707

(51) Int. Cl.
*B25C 1/04* (2006.01)
*B25C 1/00* (2006.01)

(52) U.S. Cl.
CPC ..... *B25C 1/047* (2013.01); *B25C 1/008* (2013.01)

(58) Field of Classification Search
CPC ..... B25C 1/04
USPC ..... 227/2–8, 130, 156; 173/170
See application file for complete search history.

(56) References Cited

U.S. PATENT DOCUMENTS

| | | | |
|---|---|---|---|
| 4,260,092 | A | 4/1981 | Austin |
| 5,522,532 | A | 6/1996 | Chen |
| 5,551,620 | A | 9/1996 | Vallee |
| 2004/0238590 | A1 | 12/2004 | Ishizawa et al. |

FOREIGN PATENT DOCUMENTS

| | | | |
|---|---|---|---|
| CN | 2790692 | Y | 6/2006 |
| DE | 29504745 | U1 | 5/1995 |
| GB | 2053069 | A | 2/1981 |
| JP | 56-09179 | A | 1/1981 |

OTHER PUBLICATIONS

Extended European Search Report for application EP11190662.4 dated Mar. 27, 2013.
China Intellectual Property Office office action for patent application CN201110391555.X (Dec. 26, 2013).

*Primary Examiner* — Andrew M Tecco
*Assistant Examiner* — Tara M Ho
(74) *Attorney, Agent, or Firm* — Kilpatrick Townsend & Stockton LLP

(57) ABSTRACT

A rigid member is configured to move a valve member to separate the valve member from an engaging part when a push lever moves from a lower dead center to an upper dead center. A resilient member is configured to move the valve member to separate the valve member from the engaging part when the push lever moves from the lower dead center to the upper dead center. A switching part selects one of the rigid member and the resilient member to move the valve member to separate the valve member from the engaging part. When the switching part selects the rigid member, a fastener driving operation is performed regardless of an order of a pulling operation and a pressing operation. When the switching part selects the resilient member, the fastener driving operation is performed only when the pulling operation is executed after the pressing operation is executed.

3 Claims, 14 Drawing Sheets

FASTENER DRIVING TOOL

CROSS REFERENCE TO RELATED APPLICATION

This application claims priority from Japanese Patent Application No. 2010-263707 filed Nov. 26, 2010. The entire content of each of the priority application is incorporated herein by reference.

TECHNICAL FIELD

The present invention relates to a driving tool for driving fasteners, such as nails or staples, into a workpiece.

BACKGROUND

Conventional nail guns have a well-known activation mechanism for initiating a nail-driving operation when two operations are performed simultaneously by the operator of the nail gun: (1) an operation to press a push lever protruding from the nail gun at a position near a nail ejection opening against a workpiece, such as a piece of wood, causing the push lever to slide inward along the axial direction of the nail gun body, and (2) an operation to pull a trigger on the nail gun. Some such nail guns disclosed in U.S. Pat. No. 5,551,620 have a mechanism for changing the operating mode of the nail gun in response to an operator selection.

SUMMARY

However, the conventional nail gun described above requires that a complex mechanism be built into the trigger for changing the operating mode, making assembly of the nail gun more difficult.

In view of the foregoing, it is an object of the present disclosure to provide a nail gun having a mechanism for switching the operating mode that does not necessitate a complex structure in the trigger.

In order to attain the above and other objects, the present invention provides a fastener driving tool including: a housing, a trigger, a valve, a rigid member, a resilient member, and a switching part. The trigger is supported to the housing. The push lever is supported to the housing and is movable between an upper dead center and a lower dead center in a moving direction. The fastener driving operation is performable when both of a pulling operation for pulling the trigger and a pressing operation for pressing the push lever against a workpiece are executed. The valve includes a valve member movable in the moving direction, and an engaging part configured to engage the valve member. The valve is in an open state when the valve member is separated from the engaging part, and the valve is in a closed state when the valve member is engaged with the engaging part. The rigid member is configured to move the valve member to separate the valve member from the engaging part when the push lever moves from the lower dead center to the upper dead center. The resilient member is configured to move the valve member to separate the valve member from the engaging part when the push lever moves from the lower dead center to the upper dead center. The switching part selects one of the rigid member and the resilient member to move the valve member to separate the valve member from the engaging part. When the switching part selects the rigid member, the fastener driving operation is performed regardless of an order of the pulling operation and the pressing operation. When the switching part selects the resilient member, the fastener driving operation is performed only when the pulling operation is executed after the pressing operation is executed.

DETAILED DESCRIPTION

Figure 1:
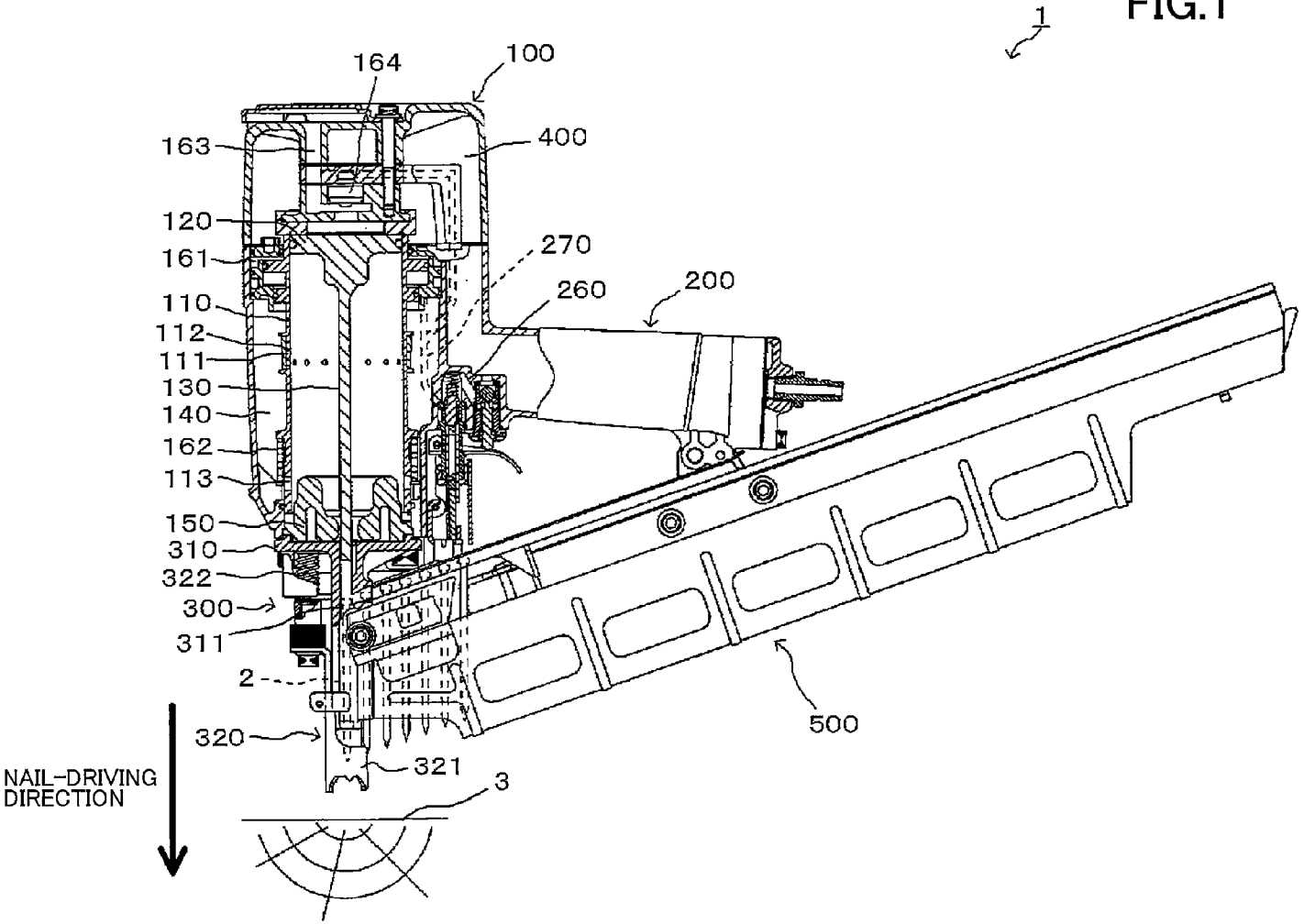
FIG. 1 is a cross-sectional view of a nail gun according to an embodiment of the present invention.

Next, a fastener driving tool according to an embodiment of the present invention will be described while referring to the accompanying drawings. The fastener driving tool according to this embodiment is a nail gun 1. The nail gun 1 functions to drive nails 2, serving as fasteners in this embodiment, into a workpiece 3. To facilitate understanding, the following description of this embodiment will assume that the nail-driving direction, i.e., the direction in which nails are ejected from the nail gun 1, is vertically downward, while the direction opposite the nail-driving direction is vertically upward.

The nail gun 1 according to this embodiment can be used to perform a first operation and a second operation. The "first operation" is a nail-driving operation in which the nail gun 1 drives one nail 2 only when the operator pulls a trigger 210 described later after first pressing a push lever 320 described later against the workpiece 3 and thereafter drives a subsequent nail 2 each time the operator releases and re-pulls the trigger 210. The "second operation" is also a nail-driving operation in which the nail gun 1 continuously drives a plurality of nails 2. The nail gun 1 executes this operation when the operator either presses the push lever 320 against a workpiece a plurality of times while the trigger 210 remains pulled, or pulls the trigger 210 a plurality of times while the push lever 320 remains pressed against the workpiece 3. In other words, in the "second operation", the nail-driving operation is performed regardless of an order of the operation for pulling the trigger 210 and the operation for pressing the push lever 320 against a workpiece. In the following description, the state in which the nail gun 1 can execute the first operation will be referred to as the "first operating mode," and the state in which the nail gun 1 can execute the second operation will be referred to as the "second operating mode." The operator can toggle the nail gun 1 between the first operating mode and second operating mode by manipulating a selector knob 254 described later.

FIG. 1 is a side cross-sectional view of the nail gun 1 according to this embodiment of the present invention. As shown in FIG. 1, the nail gun 1 is integrally provided with a main body (housing) 100, a handle section 200 extending in a direction substantially orthogonal to the vertical, and a nose section 300 positioned on the lower end of the housing 100. An accumulating chamber 400 is formed in the handle section 200 and housing 100 of the nail gun 1 for accumulating compressed air received from a compressor (not shown). The accumulating chamber 400 is connected to the compressor by an air hose (not shown).

The housing 100 houses a cylinder 110, a piston 120 that can slidably reciprocate up and down in the cylinder 110, and a driver blade 130 formed integrally with the piston 120.

The inner surface of the cylinder 110 slidably supports the piston 120. A return-air chamber 140 is formed around the lower portion of the cylinder 110 for collecting compressed air required to return the driver blade 130 to its top dead center. An air passage 112 is formed in a central part of the cylinder 110 with respect to the axial direction thereof. The air passage 112 is provided with a check valve 111 that allows compressed air to flow only in a direction from the interior of the cylinder 110 into the return-air chamber 140 outside the cylinder 110. An air passage 113 is formed on the lower end portion of the cylinder 110. The air passage 113 is open to the return-air chamber 140 at all times. A piston bumper 150 is provided on the bottom edge of the cylinder 110 for absorbing excess energy in the piston 120 when the piston 120 moves rapidly downward and strikes a nail. The piston bumper 150 is formed of an elastic material, such as rubber. A through-hole is formed in the center of the piston bumper 150 for receiving the driver blade 130.

The piston 120 is disposed inside the cylinder 110 and is vertically slidable. The driver blade 130 is integrally formed with the bottom surface of the piston 120, extending downward from the general center of the bottom surface. The piston 120 divides the interior of the cylinder 110 into an upper piston chamber and a lower piston chamber. During a nail-driving operation, compressed air flows into the upper piston chamber, forcing the piston 120 rapidly downward. The driver blade 130 also moves rapidly downward together with the piston 120 and slides into an ejection channel 311 described later to impact the nail 2.

Around the upper portion of the cylinder 110, the housing 100 is provided with a main valve chamber 161, a spring 162 for urging the cylinder 110 downward, an air passage 163 providing external communication with the upper piston chamber, and an exhaust valve 164 for opening and closing the air passage 163.

The handle section 200 is the portion of the nail gun 1 gripped by the operator. As shown in the enlarged view of FIG. 2, the portion of the handle section 200 that is connected to the housing 100 includes a trigger 210 that is manipulated by the operator; a trigger valve 220 configured of a diverter valve for determining whether compressed air in the accumulating chamber 400 is supplied to or discharged from the upper piston chamber; a trigger plunger 230 for toggling the trigger valve 220 open and closed; a push lever valve 240 configured of a diverter valve for changing whether compressed air is supplied to or discharged from the main valve chamber 161; a push lever plunger unit 250 for toggling the push lever valve 240 open and closed; an air channel 260 formed between the trigger valve 220 and push lever valve 240; and an air channel 270 formed between the push lever valve 240, main valve chamber 161, and exhaust valve 164.

The operator operates the trigger 210 in order to open and close the trigger valve 220 through the trigger plunger 230. The trigger 210 is configured of a main trigger unit 211 that is capable of pivoting relative to the housing 100, and a spring 212 for urging the main trigger unit 211 clockwise about its rotational center part 211*a*. The main trigger unit 211 is configured of the rotational center part 211*a* possessing the rotational center of the main trigger unit 211, an operating part 211*b* that is manipulated by the operator, and a contact part 211*c* that contacts the trigger plunger 230 when the operator pulls the trigger 210. During a nail-driving operation, the operating part 211*b* moves upward in FIG. 2, i.e., counterclockwise about the rotational center part 211*a*, against the urging force of the spring 212. Through this movement, the contact part 211*c* contacts the lower end of the trigger plunger 230 and pushes a valve member 221 of the trigger valve 220 described later upward through the trigger plunger 230 against the pressure generated by the compressed air in the trigger valve chamber 223. The trigger valve 220 is shifted into an open state when the valve member 221 is moved in this way.

The trigger valve 220 is configured of a substantially spherical valve member 221, and an engaging part 222 that engages with the valve member 221. The valve member 221 is accommodated in a trigger valve chamber 223. The trigger valve chamber 223 is in communication with both the accumulating chamber 400 and the air channel 260. The engaging part 222 is an edge part defining an opening 224 beneath the trigger valve chamber 223. The opening 224 is in communication with the trigger valve chamber 223 and has a smaller diameter than that of the valve member 221. When the valve member 221 incurs a downward force due to pressure of compressed air in the trigger valve chamber 223, the valve member 221 engages with the engaging part 222, closing the opening 224. At this time, the trigger valve 220 is in a closed state. On the other hand, if the trigger plunger 230 moves the valve member 221 upward against the force of compressed air in the trigger valve chamber 223, the valve member 221 separates from the engaging part 222, exposing the opening 224. At this time, the trigger valve 220 is in an open state.

The trigger plunger 230 is disposed below the valve member 221 and is vertically movable. When the trigger 210 is pulled so as to press against the bottom end of the trigger plunger 230, the trigger plunger 230 moves upward and pushes the valve member 221 of the trigger valve 220 upward against the pressure of compressed air. As a result, the trigger valve 220 is shifted into its open state.

The push lever valve 240 functions to change the flow of compressed air in a direction toward the air channel 270 when actuated by the push lever 320 described later. The push lever valve 240 is configured of a bushing 241, a valve member 242, and a spring 243.

The bushing 241 is tube-like in shape and is fixed to the housing 100. A through-hole 241*a* formed in the tube-like bushing 241 extends in a general vertical direction. The through-hole 241*a* guides a plunger 251 described later in sliding up and down. The bushing 241 also includes an opening 241*b* formed in the top end thereof; an engaging part 241*c* forming the opening 241*b* for engaging the valve member 242; recessed parts 241*d* formed in the lower end of the bushing 241 in which is fitted a ratchet spring 255 described later; an opening 241*e* formed in the side wall of the bushing 241 to allow communication between the air channel 270 and through-hole 241*a*; and a compressed air outlet 241*f* formed in the wall of the bushing 241 on the push lever 320 side of the through-hole 241*a*.

The valve member 242 moves up and down to open or close the opening 241*b* formed in the top end of the bushing 241. The opening 241*b* is closed when the valve member 242 is engaged with the engaging part 241*c*, placing the push lever valve 240 in a closed state. The opening 241*b* is exposed when the valve member 242 moves upward, disengaging the valve member 242 from the engaging part 241*c* and changing the push lever valve 240 to an open state. The spring 243 urges the valve member 242 in a downward direction.

One end of the spring 243 is fixed to the housing 100, while the other end contacts the valve member 242 and urges the valve member 242 downward. The force with which the spring 243 urges the valve member 242 downward is less than the force with which a spring 253 of the push lever plunger unit 250 described later urges the valve member 242 upward when the push lever 320 described later is pressed during the first operating mode. The spring 253 serves as a resilient member.

Figure 2:
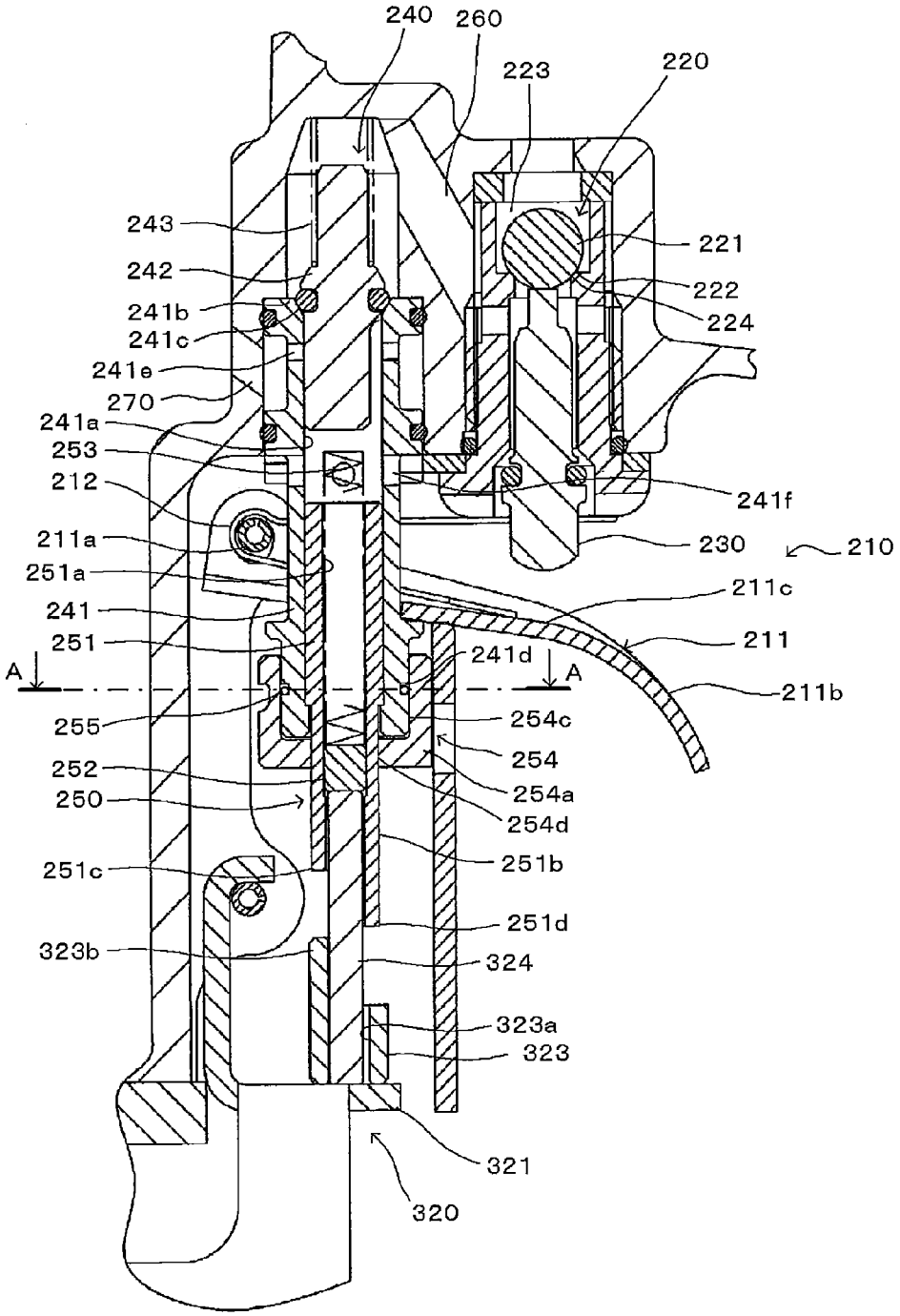
FIG. 2 is a cross-sectional view showing relevant parts of the nail gun in a first operating mode when neither an operation for pulling a trigger nor an operation for pressing a push lever has been performed.
Figure 3:
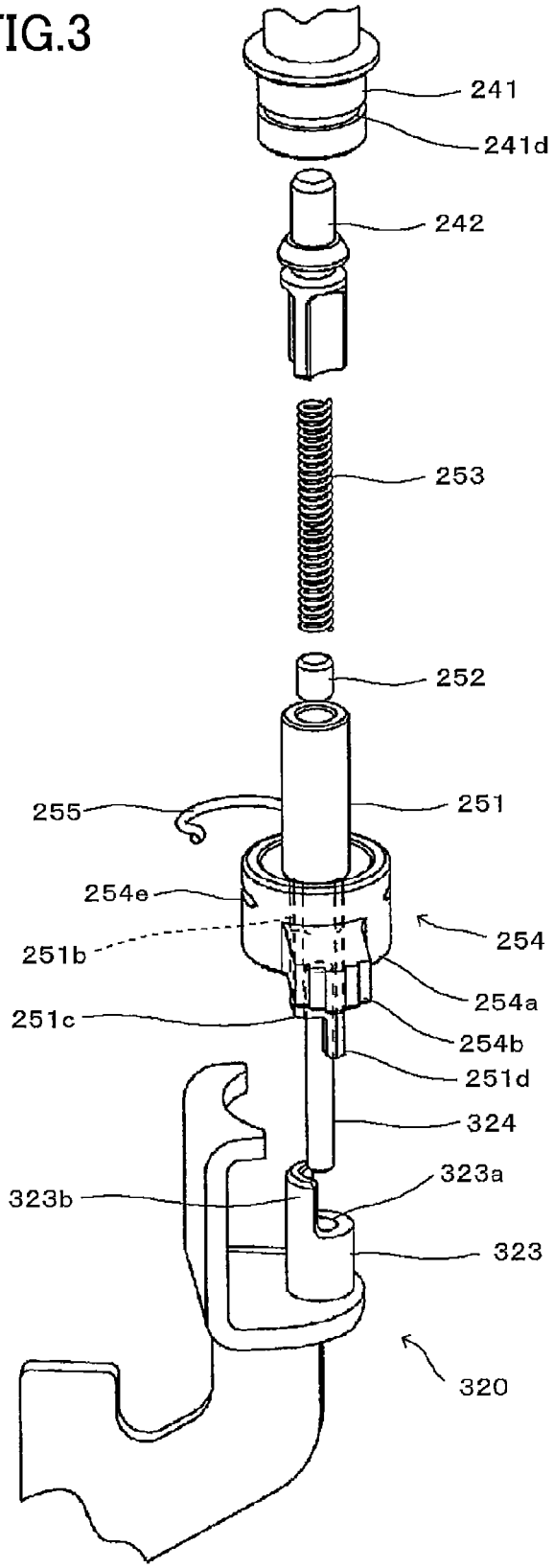
FIG. 3 is an exploded perspective view of a push lever plunger unit according to the embodiment.

The push lever plunger unit 250 moves up and down together with the push lever 320 to open and close the push lever valve 240. FIG. 3 is an exploded perspective view of the push lever plunger unit 250. As shown in FIGS. 2 and 3, the push lever plunger unit 250 is configured of the plunger 251, a sealing member 252, the spring 253, a selector knob 254, and the ratchet spring 255.

The plunger 251 has a tube-like shape with an interior through-hole 251*a* extending in a general vertical direction. The plunger 251 is formed of a highly rigid material, such as steel and serves as a rigid member. The plunger 251 is capable of rotating inside the through-hole 241*a* and rotates when the operator manually rotates the selector knob 254. The plunger 251 is also capable of translational motion within the through-hole 241*a* along the vertical. A square column part 251*b* is formed on the bottom of the plunger 251. The square column part 251*b* has a square-shaped cross section viewed in a vertical direction. The square column part 251*b* penetrates a square-shaped through-hole 254*d* formed in the selector knob 254. The square cross-sectional shape of the square column part 251*b* viewed in a vertical direction is substantially equivalent in size to that of the square-shaped through-hole 254*d*. Hence, when the selector knob 254 is rotated about its central axis aligned with the vertical, the plunger 251 rotates the same angular distance as the selector knob 254. The selector knob 254 serves as a switching part.

Figure 6:
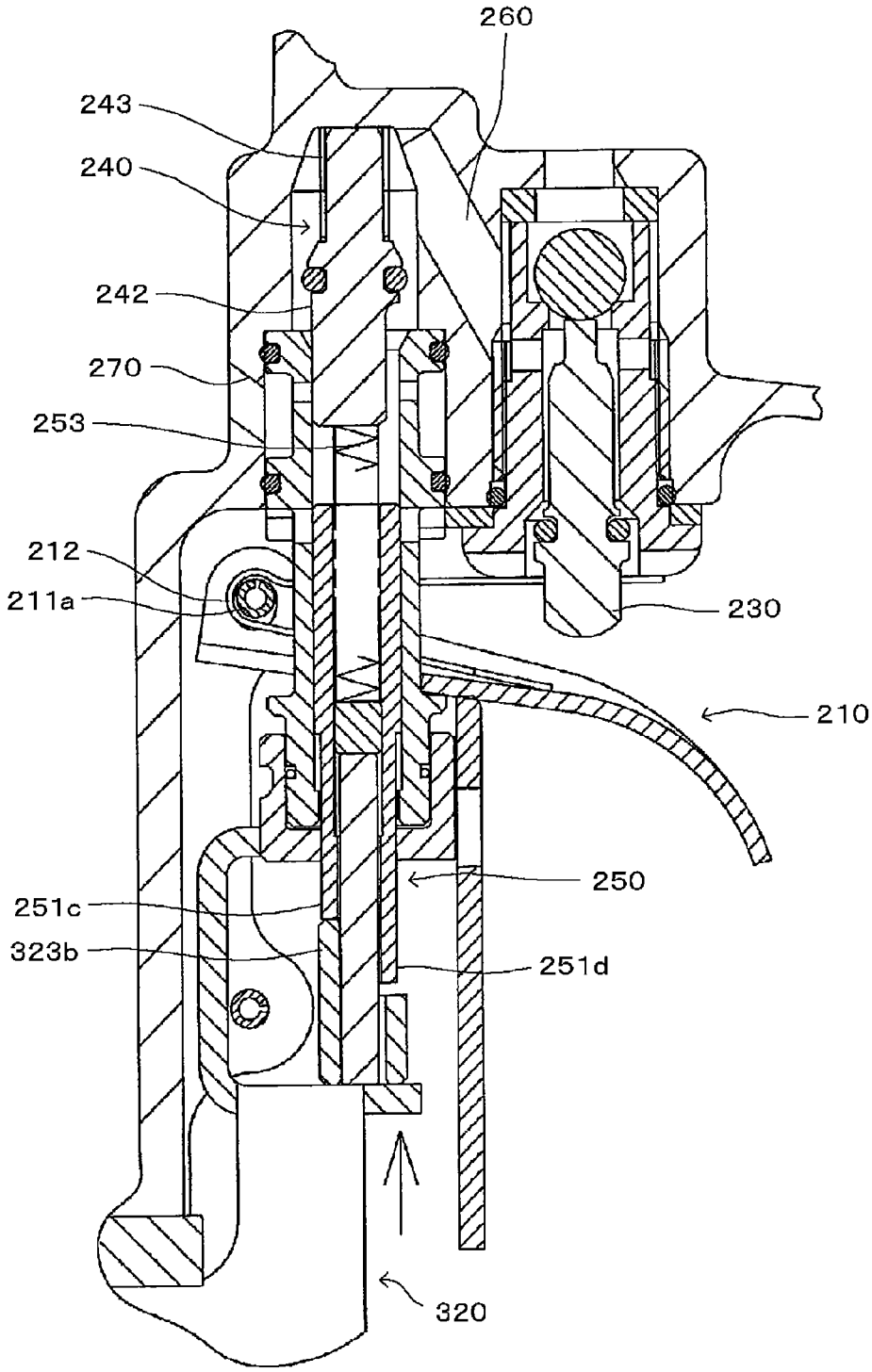
FIG. 6 is a cross-sectional view of the nail gun illustrating changes from the state in FIG. 2 that occur after the push lever is pressed against a workpiece.
Figure 14:
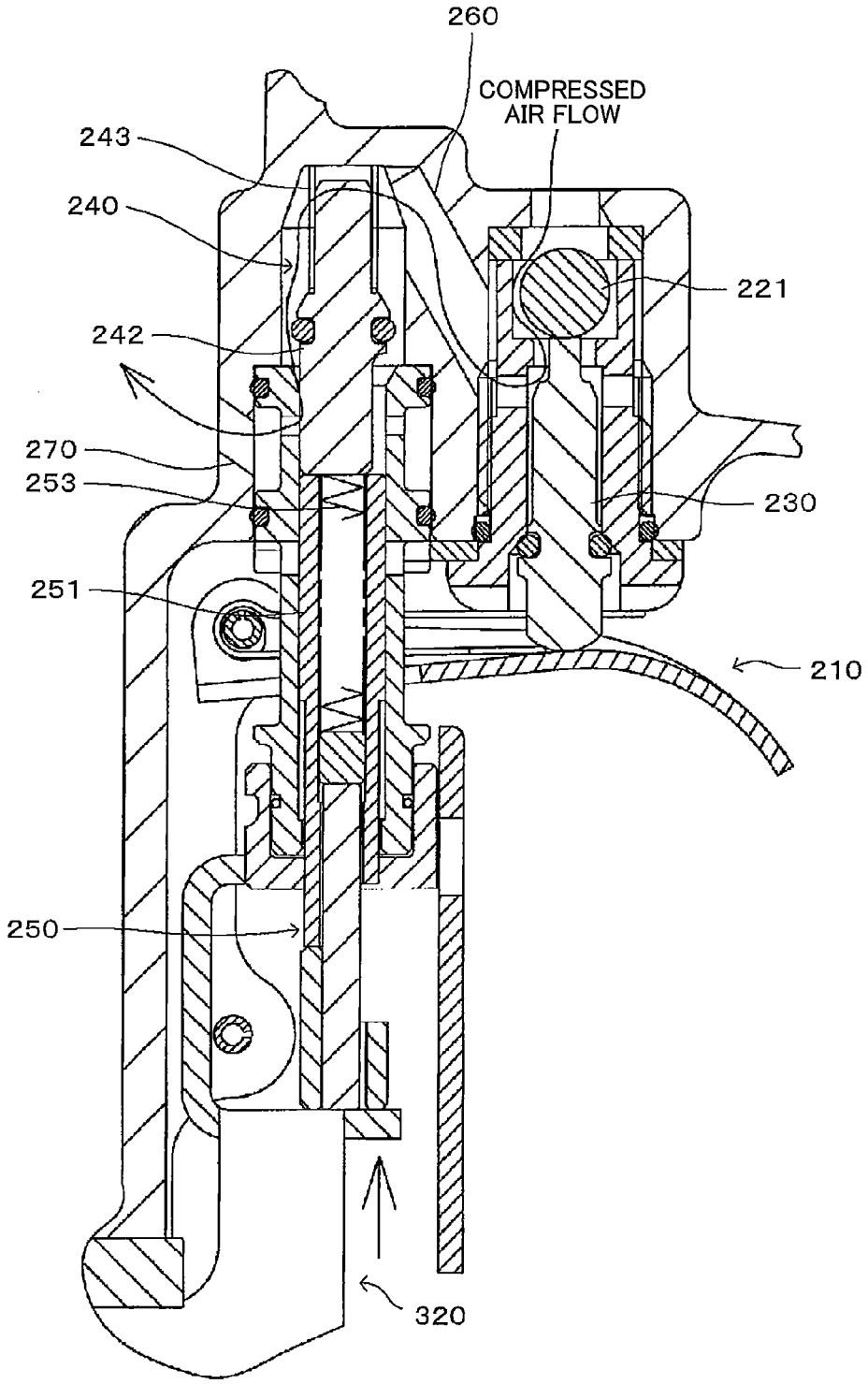
FIG. 14 is a cross-sectional view of the nail gun illustrating changes from the state in FIG. 13 after the push lever is once again pressed against the workpiece.

A first contact part 251*c* and a second contact part 251*d* are formed on the bottom end of the square column part 251*b*. The second contact part 251*d* protrudes farther downward than the first contact part 251*c*. When the push lever 320 described later is pressed in the first operating mode, the first contact part 251*c* is contacted by a protruding part 323*b* of the push lever 320 and rises together with the push lever 320, as illustrated in FIG. 6. When the push lever 320 is pressed during the second operating mode, the second contact part 251*d* is contacted by the protruding part 323*b* of the push lever 320 and rises together with the push lever 320, as illustrated in FIG. 14. Note that the distance in which the second contact part 251*d* protrudes farther downward than the first contact part 251*c* is set such that the upper end of the plunger 251 does not contact the lower end of the valve member 242 constituting the push lever valve 240 when the push lever 320 moves to the upper dead center in the first operating mode, and the upper end of the plunger 251 presses the lower end of the valve member 242 upward in the second operating mode, shifting the push lever valve 240 into its open state.

The sealing member 252 slides within the through-hole 251*a* of the plunger 251 and forms a seal with the plunger 251 so that compressed air within the through-hole 251*a* does not leak externally. When the push lever 320 is pressed against the workpiece 3, the sealing member 252 is pushed upward by the top end of a push lever rod 324 described later. The plunger 251 is designed such that its upper end exposes the compressed air outlet 241*f* formed in the bushing 241 when the plunger 251 is at its lower dead center, and blocks the compressed air outlet 241*f* when the plunger 251 is at its upper dead center.

The spring 253 is provided in the through-hole 251*a* of the plunger 251. The bottom end of the spring 253 contacts the sealing member 252. When the push lever 320 moves upward in the first operating mode, the spring 253 rises together with the sealing member 252. Consequently, the upper end of the spring 253 presses against the lower end of the valve member 242, pushing the valve member 242 upward and shifting the push lever valve 240 into its open state. The force with which the spring 253 presses the valve member 242 upward is smaller than the combined force that urges the valve member 242 downward, including the force of compressed air in the trigger valve chamber 223 and the force of the spring 243 against the push lever valve 240. However, when the push lever valve 240 is in communication with the atmosphere, the force with which the spring 253 pushes the valve member 242 upward is greater than the force with which the spring 243 of the push lever valve 240 urges the valve member 242 downward.

Figure 4:
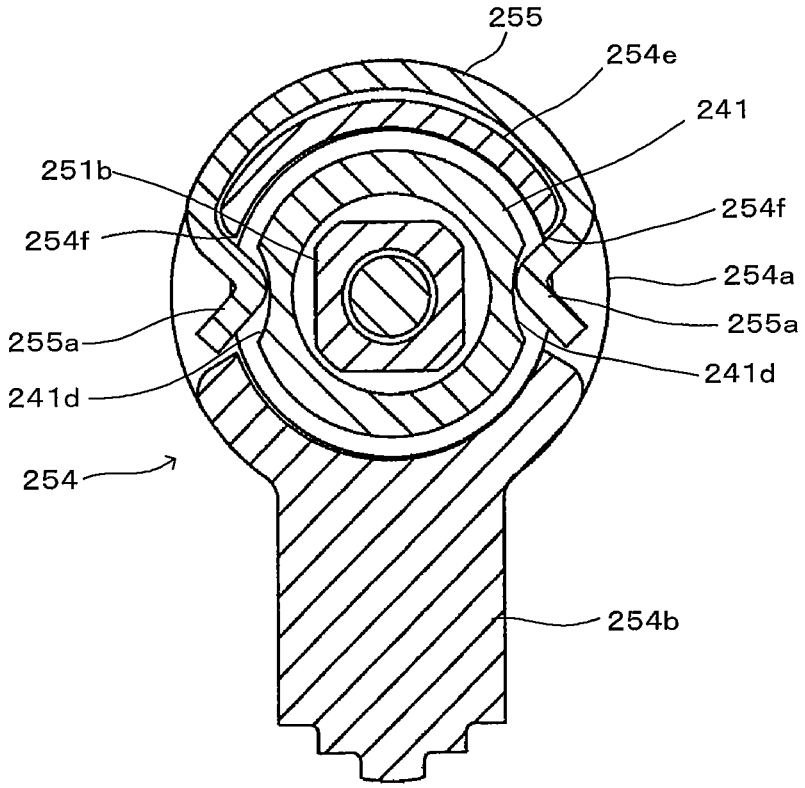
FIG. 4 is a cross-sectional view showing the nail gun taken along the plane A-A in FIG. 2.

The selector knob 254 functions to switch the operating mode of the nail gun 1 between the first operating mode and the second operating mode. Specifically, by rotating the selector knob 254 approximately 180 degrees in a direction substantially orthogonal to the vertical, the operator can switch the nail gun 1 from one mode to the other. As shown in FIGS. 2 through 4, the selector knob 254 has a tube-like part 254*a* and an operating part 254*b* that is manipulated by the operator. The tube-like part 254*a* has a fitting part 254*c* in which the lower end of the bushing 241 can be fitted, and is formed with a through-hole 254*d* at the lower portion of the fitting part 254*c*, a groove 254*e* at the outer surface of the tube-like part 254*a* in which the ratchet spring 255 can be fitted, and insertion holes 254*f* for inserting protruding parts 255*a* of the ratchet spring 255. The through-hole 254*d* is substantially square-shaped for receiving the square column part 251*b* of the plunger 251.

The ratchet spring 255 serves to hold the selector knob 254 in a stable position in either the first or second operating mode. As shown in FIG. 4, the ratchet spring 255 is substantially C-shaped, with one protruding part 255*a* protruding inward from each end of the ratchet spring 255. The protruding parts 255*a* protrude inward through the insertion holes 254*f* formed in the selector knob 254 and function to press the bushing 241 inward. Hence, when the selector knob 254 is rotated, the ratchet spring 255 rotates together with the selector knob 254 while continuing to apply pressure to the bushing 241. The protruding parts 255*a* contact the recessed parts 241*d* formed in the bushing 241 in both the first and second operating modes, but also contact portions on the outer peripheral surface of the bushing 241 in which the recessed parts 241*d* are not formed while in the process of switching from mode to the other. Accordingly, since the protruding parts 255*a* are engaged in the recessed parts 241*d* in both the first and second operating modes, the ratchet spring 255 can hold the selector knob 254 firmly so that the selector knob 254 does not migrate between positions corresponding to the first operating mode and the second operating mode.

As shown in FIG. 1, the nose section 300 guides the nail 2 and the driver blade 130 so that the driver blade 130 reliably contacts the nail 2, driving the nail 2 into a desired position in the workpiece 3. The nose section 300 is configured of an ejection unit 310 provided internally with the ejection channel 311 for guiding the nail 2 and driver blade 130, and the push lever 320 capable of moving vertically along the outer surface of the ejection unit 310. The ejection unit 310 is formed with a flange on its top end that is connected to the bottom end of the housing 100 around the opening formed therein. A magazine 500 accommodating a plurality of the nails 2 is also mounted on the ejection unit 310. A feeder that is made to reciprocate by compressed air and an elastic member supplies nails 2 in the magazine 500 to the ejection channel 311 one after another.

As shown in FIGS. 1 and 2, the push lever 320 is configured of a main push lever body 321 that contacts the workpiece 3, a push lever spring 322 for urging the main push lever body 321 downward, a contact part 323 that moves up and down together with the main push lever body 321 and contacts the push lever plunger unit 250, and a push lever rod 324 for guiding movement of the contact part 323.

The main push lever body 321 is connected to the housing 100 through the push lever spring 322. In the standby state, the bottom end of the main push lever body 321 protrudes lower than the bottom end of the ejection unit 310, as shown in FIG. 1. However, during a nail-driving operation, the housing 100 is pressed toward the workpiece 3, causing the main push lever body 321 to incur a reaction force from the workpiece 3. At this time, the main push lever body 321 moves upward relative to the housing 100 and handle section 200 against the urging force of the push lever spring 322.

As shown in FIG. 2, the contact part 323 is provided on the top of the main push lever body 321 beneath the push lever plunger unit 250. The contact part 323 is formed in a tube-like shape and extends upward from the top of the main push lever body 321. A through-hole 323*a* is formed inside the contact part 323 for accommodating the push lever rod 324. The contact part 323 also has a protruding part 323*b* that protrudes farther upward from the top opening of the through-hole 323*a*. The protruding part 323*b* contacts the first contact part 251*c* of the push lever plunger unit 250 in the first operating mode and contacts the second contact part 251*d* of the push lever plunger unit 250 in the second operating mode.

Together with the contact part 323 of the push lever 320, the push lever rod 324 functions to connect the push lever 320 to the push lever plunger unit 250. The push lever rod 324 also functions to guide movement of the contact part 323 toward the push lever plunger unit 250 when the push lever 320 is pressed against the workpiece 3 and forced to move from its lower dead center to its upper dead center. The top end of the push lever rod 324 is positioned within the through-hole 251*a* of the plunger 251, while the bottom end is positioned within the through-hole 323*a* of the contact part 323.

Figure 5:
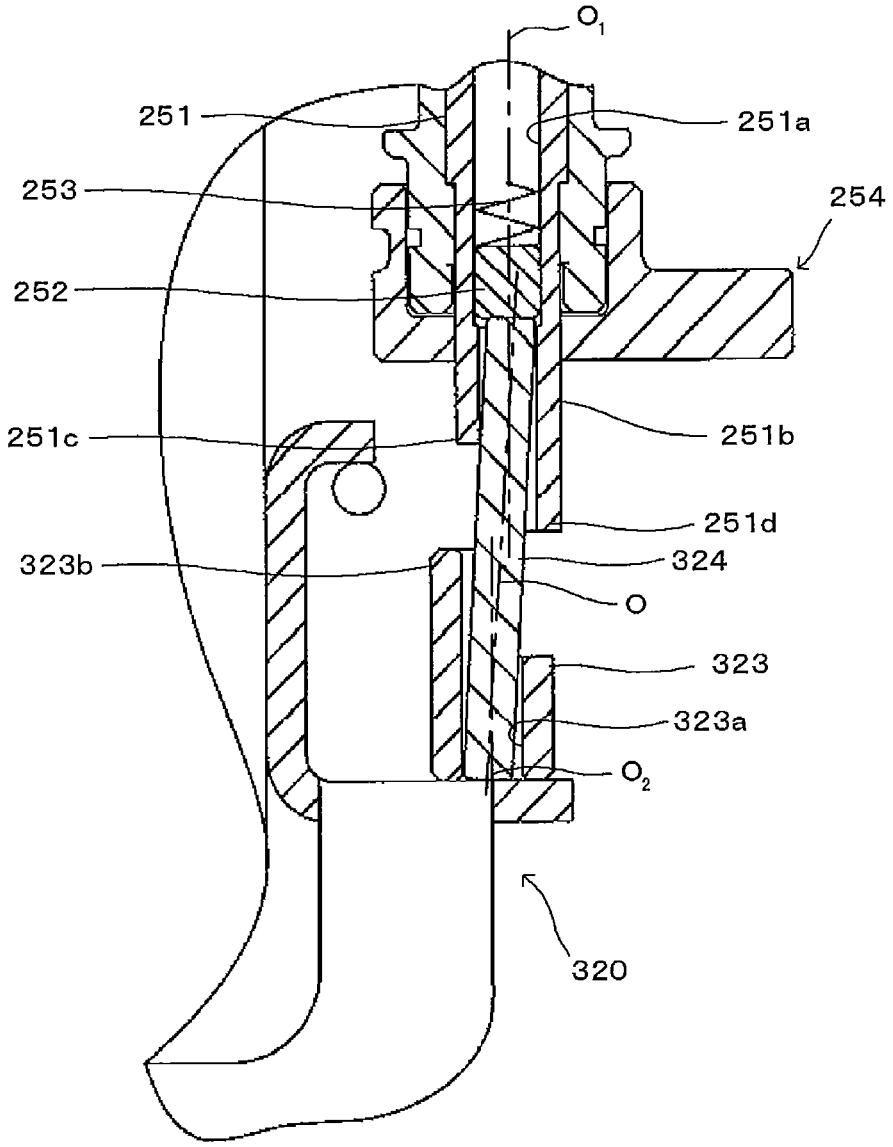
FIG. 5 is an explanatory diagram illustrating the function of a push lever rod when the push lever is pressed against a workpiece.

Here, the operation of the push lever rod 324 when the push lever 320 is pressed against the workpiece 3 will be described. The enlarged view of FIG. 5 shows the state of the push lever 320 when the push lever 320 is not being pressed against the workpiece 3. In this state, the central axis $O_1$ of the through-hole 251*a* is not aligned with the central axis $O_2$ of the through-hole 323*a*. This misalignment may result from factors in the assembly of the nail gun 1 or the provision of a gap between the push lever 320 and the outsides of the ejection unit 310 and housing 100 designed to prevent an increase in sliding resistance caused by irregularities in part dimensions and dust accumulation.

Accordingly, the push lever rod 324 is formed with a smaller diameter than the inner diameters of the through-hole 251*a* and the through-hole 323*a* and is oriented such that its center axis O is sloped relative to the central axis O1 of the through-hole 251*a* and the central axis $O_2$ of the through-hole 323*a*. If the push lever rod 324 were not provided and the push lever 320 were pressed against the workpiece 3 while the central axis $O_1$ of the through-hole 251*a* and central axis $O_2$ of the through-hole 323*a* were misaligned in this way, the first contact part 251*c* and second contact part 251*d* of the plunger 251 might not contact the protruding part 323*b* of the push lever 320 properly. Hence, the push lever rod 324 is provided in this embodiment to guide movement of the contact part 323 when the push lever 320 is pressed against the workpiece 3 and moved from its lower dead center to its upper dead center.

That is, as the push lever rod 324 moves upward with the push lever 320, the portion of the push lever rod 324 guided into the through-hole 251*a* increases in length, forcing the push lever rod 324 to adjust its orientation within the through-holes 251*a* and 323*a* so as to reduce the angle that the center axis O of the push lever rod 324 slopes relative to the central axis $O_1$ of the through-hole 251*a*. The push lever rod 324 subsequently guides the contact part 323 in a direction that brings the central axis $O_2$ of the through-hole 323*a* closer into alignment with the central axis $O_1$ of the through-hole 251*a*. Since the contact part 323 is moving upward while being guided by the push lever rod 324 in this way, the first contact part 251*c* and second contact part 251*d* of the plunger 251 can reliably contact the protruding part 323*b* of the push lever 320. Therefore, the protruding part 323*b* can properly transmit the upward force to the first contact part 251*c* and second contact part 251*d*.

Next, the operations of the nail gun 1 having the above construction will be described.

First, the operations of the nail gun 1 according to this embodiment will be described for performing the first operation. To perform the first operation, the operator sets the nail gun 1 in the first operating mode by rotating the selector knob 254. In the first operating mode, the nail gun 1 is in the state shown in FIG. 2 while the push lever 320 has not been pressed and the trigger 210 has not been pulled. While the nail gun 1 is in this state, the operator presses the bottom end of the push lever 320 against the workpiece 3, moving the push lever 320 to its upper dead center. As shown in FIG. 6, the spring 253 of the push lever plunger unit 250, which moves upward together with the push lever 320 at this time, pushes the valve member 242 of the push lever valve 240 upward against the urging force of the spring 243. Accordingly, the push lever valve 240 is switched to an open state, allowing communication between the air channel 260 and air channel 270.

Figure 7:
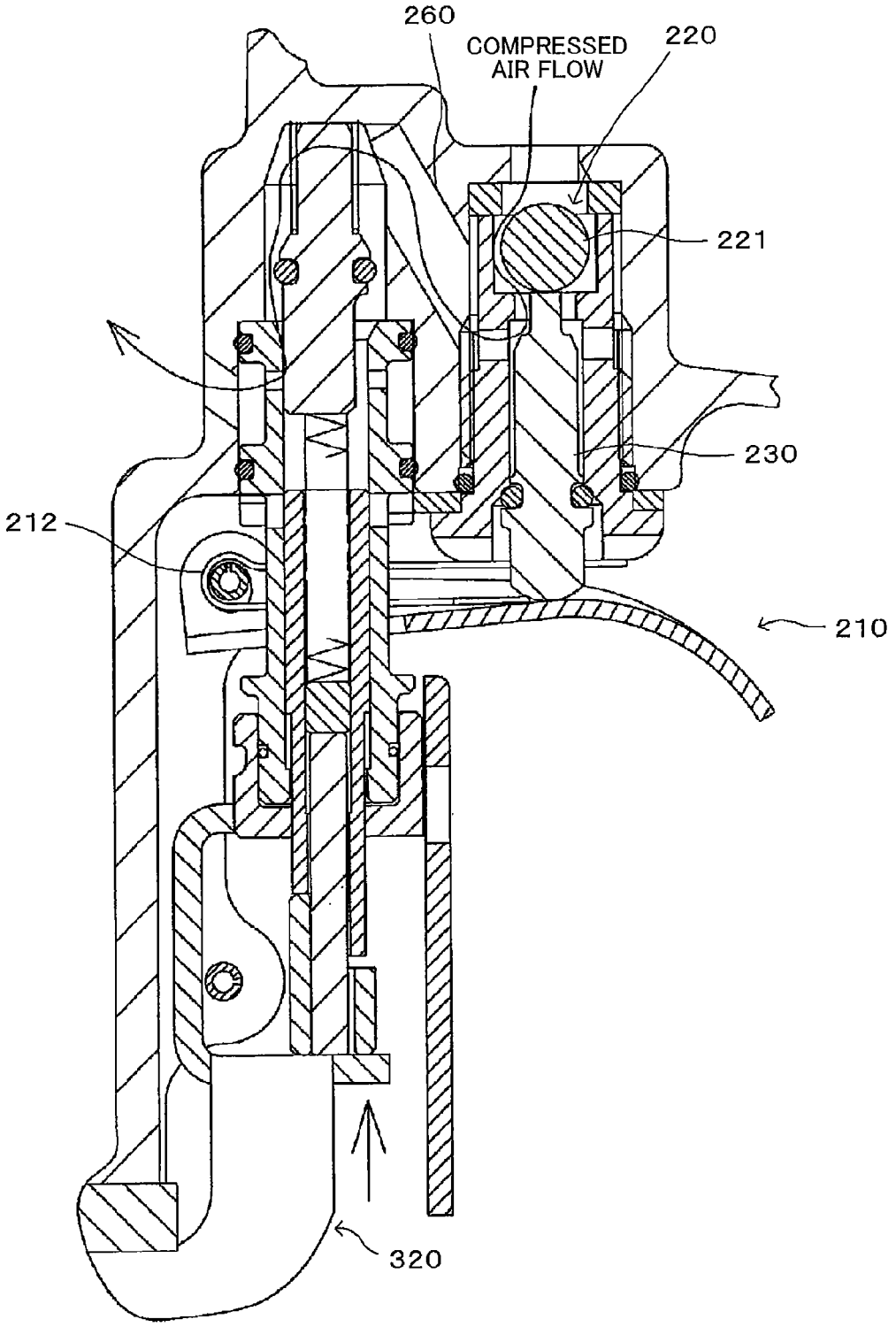
FIG. 7 is a cross-sectional view of the nail gun illustrating changes from the state of FIG. 6 occurring after the trigger is pulled.

Next, the operator pulls the trigger 210 against the urging force of the spring 212. At this time, the trigger 210 pivots counterclockwise in the drawings about the rotational center part 211*a* from the state shown in FIG. 6 to the state shown in FIG. 7. The trigger 210 contacts the bottom end of the trigger plunger 230 and, through the trigger plunger 230, moves the valve member 221 of the trigger valve 220 upward against the force of compressed air in the trigger valve chamber 223. Consequently, the trigger valve 220 is placed in its open state, allowing communication between the accumulating chamber 400 and air channel 260.

Through these operations, the accumulating chamber 400 is now in fluid communication with the main valve chamber 161 through the trigger valve chamber 223, air channel 260, and air channel 270, allowing compressed air in the accumulating chamber 400 to flow into the main valve chamber 161. The compressed air flowing into the main valve chamber 161 moves the cylinder 110 downward against the urging force of the spring 162. This downward movement of the cylinder 110 allows compressed air in the accumulating chamber 400 to flow through the gap formed above the upper end of the cylinder 110 of the cylinder 110 into the upper piston chamber. Further, the compressed air flowing into the air channel 270 causes the exhaust valve 164 to block the air passage 163, which provides communication between the upper piston chamber and the external air. As a result, the piston 120 and driver blade 130 move rapidly downward from the force of compressed air flowing into the upper piston chamber, and the tip of the driver blade 130 strikes and drives the nail 2 into the workpiece 3. At this time, air in the lower piston chamber flows through the air passage 113 into the return-air chamber 140. The compressed air also flows into the return-air chamber 140 through the check valve 111 after the piston 120 moves lower than the air passage 112. The piston 120 subsequently impacts the piston bumper 150 at its lower dead center. The piston bumper 150 deforms from this impact to absorb excess energy in the piston 120 leftover after the nail 2 was driven.

If the operator releases the trigger 210 after completing a nail-driving operation while the push lever 320 remains pressed against the workpiece 3, the trigger 210 is moved downward in the drawings and returned to the state shown in FIG. 6 by the urging force of the spring 212. When the trigger 210 moves downward, the force of compressed air in the trigger valve chamber 223 pushes the trigger plunger 230 downward, allowing compressed air to escape externally through the gap formed between the trigger plunger 230 and the walls surrounding the trigger plunger 230. The valve member 221 of the trigger valve 220 also moves downward with the trigger plunger 230, switching the trigger valve 220 to its closed state, and switching the exhaust valve 164 to its open state so that compressed air can be discharged from the upper piston chamber. Further, the compressed air in the return-air chamber 140 flows into the lower piston chamber, causing the piston 120 to rise. If the operator subsequently separates the push lever 320 from the workpiece 3, the urging force of the push lever spring 322 moves the push lever 320 to its lower dead center, returning the nail gun 1 to its original state (the state prior to the nail-driving operation) shown in FIG. 2.

Alternatively, if the operator separates the push lever 320 from the workpiece 3 after the nail-driving operation while continuing to pull the trigger 210, the urging force of the push lever spring 322 moves the push lever 320 downward from the upper dead center. At this time, the spring 253 of the push lever plunger unit 250 also moves downward with the push lever 320. Hence, the urging force of the spring 243 provided in the push lever valve 240 moves the valve member 242 downward, thereby shifting the push lever valve 240 into its closed state. Since the plunger 251 moves to its lower dead center at this time, compressed air can escape through the air channel 270 and compressed air outlet 241*f*. The resulting lower air pressure in the main valve chamber 161 allows the cylinder 110 to return to its upper dead center. At the same time, compressed air above the piston 120 is exhausted from the exhaust valve 164, allowing the piston 120 to return to its upper dead center.

Figure 8:
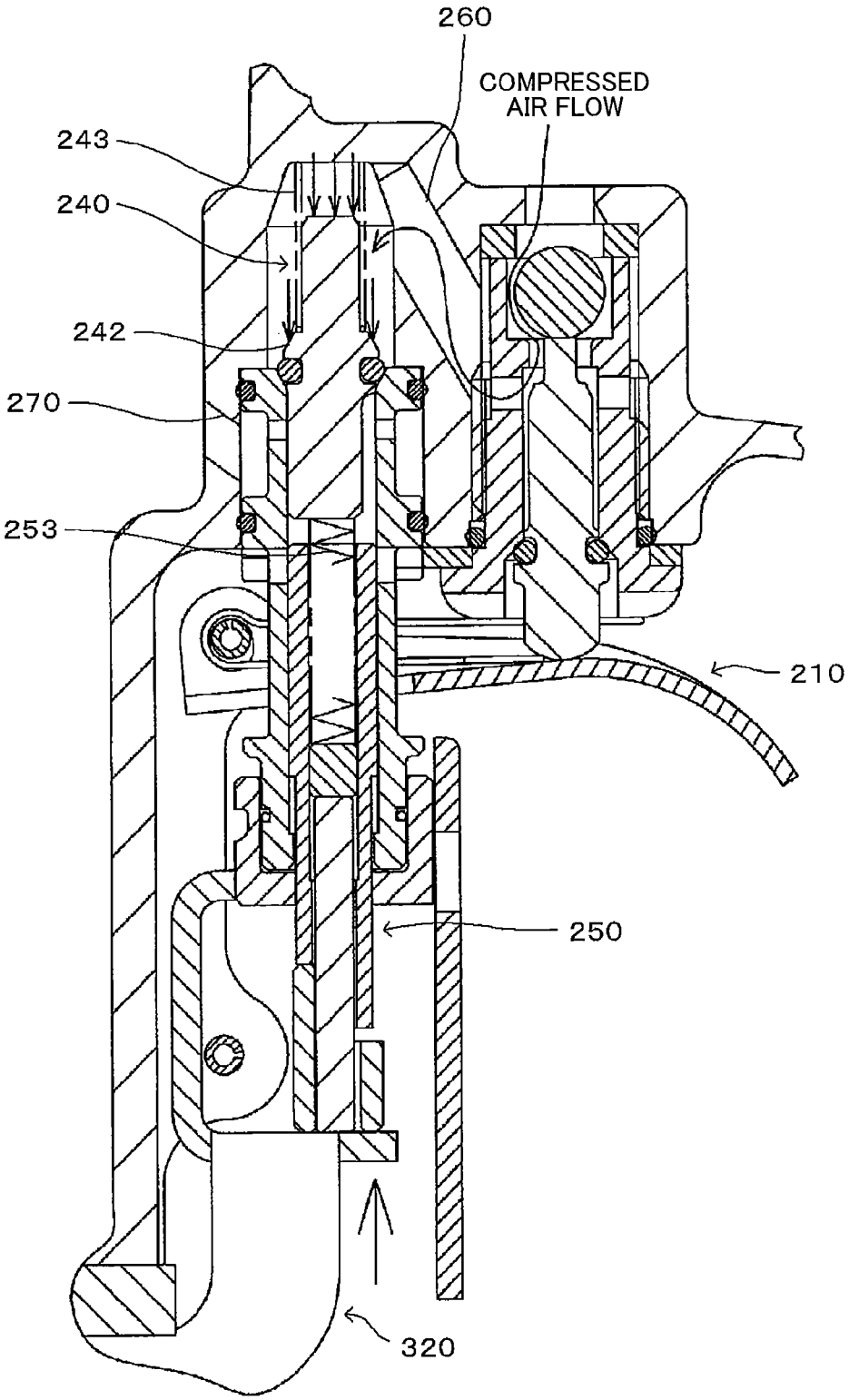
FIG. 8 is a cross-sectional view of the nail gun illustrating changes from the state in FIG. 7 occurring when the push lever is temporarily released and subsequently pressed once more against the workpiece while the trigger remains pulled.

If the push lever 320 is once again pressed against the workpiece 3 in this state, the push lever plunger unit 250 moves upward together with the push lever 320, and the upper end of the spring 253 contacts the bottom end of the valve member 242 provided in the push lever valve 240, as shown in FIG. 8. However, the force with which the spring 253 of the push lever plunger unit 250 pushes the valve member 242 of the push lever valve 240 upward is smaller than the force with which the spring 243 of the push lever valve 240 and the compressed air in the trigger valve chamber 223 push the valve member 242 downward. Accordingly, the push lever valve 240 remains in its closed state, preventing communication between the air channel 260 and air channel 270. Hence, a nail-driving operation is not performed.

Figure 9:
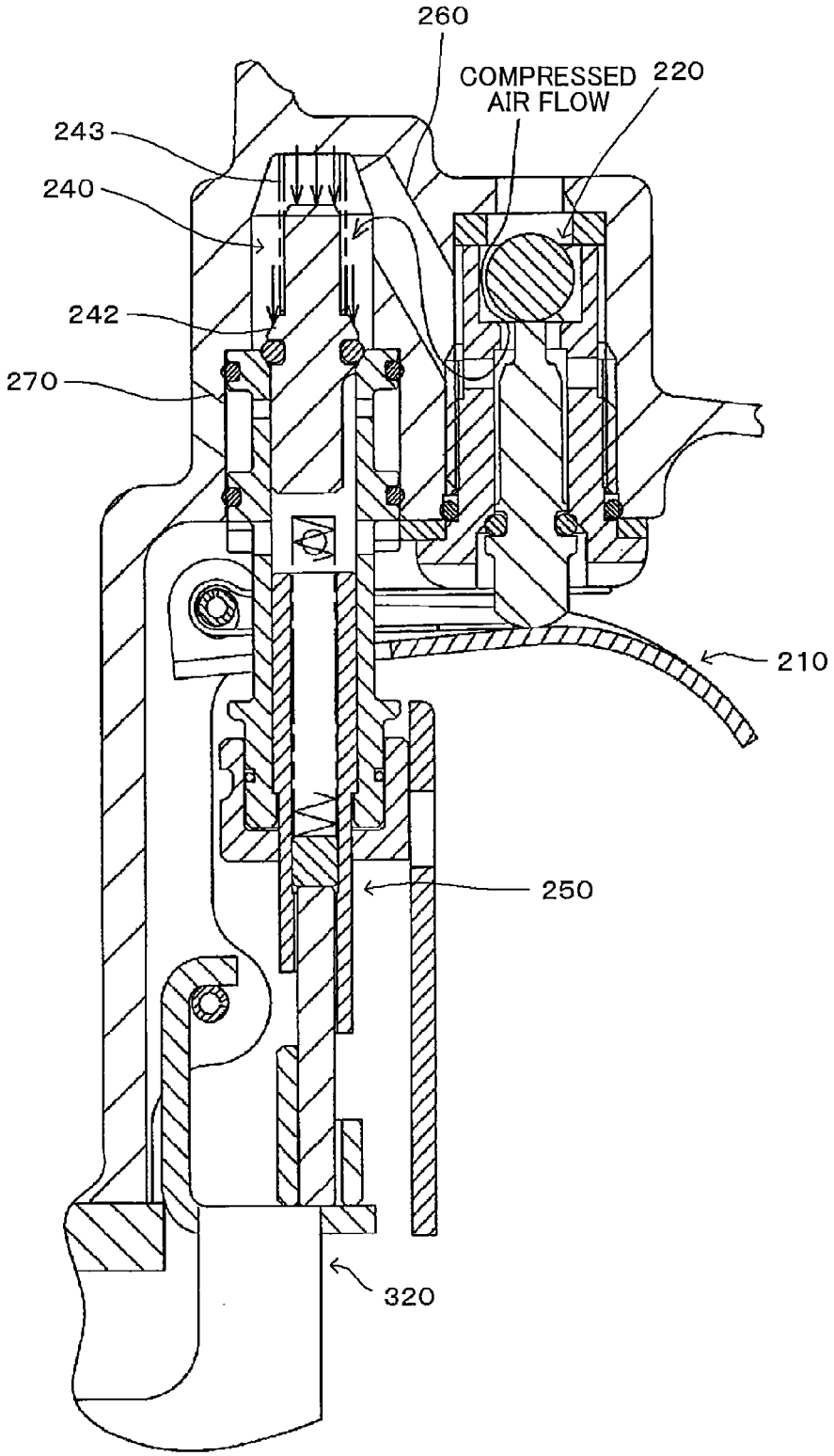
FIG. 9 is a cross-sectional view of the nail gun illustrating changes from the state in FIG. 2 after the trigger is pulled.

Further, if the operator pulls the trigger 210 of the nail gun 1 in the state shown in FIG. 2 prior to pressing the push lever 320 against the workpiece 3, the trigger valve 220 shifts to the open state shown in FIG. 9, allowing compressed air in the accumulating chamber 400 to flow through the air channel 260 into the push lever valve 240. If the operator subsequently presses the push lever 320 against the workpiece 3 while the nail gun 1 is in this state, the nail gun 1 will not execute a nail-driving operation, just as when the operator repeatedly presses the push lever 320 against the workpiece 3 while continuing to pull the trigger 210 as described with reference to FIG. 8.

Hence, in the first operating mode the nail gun 1 only drives a nail 2 when the operator presses the push lever 320 and subsequently pulls the trigger 210. Thereafter, the operator can drive subsequent nails 2 by first releasing and then re-pulling the trigger 210.

Figure 10:
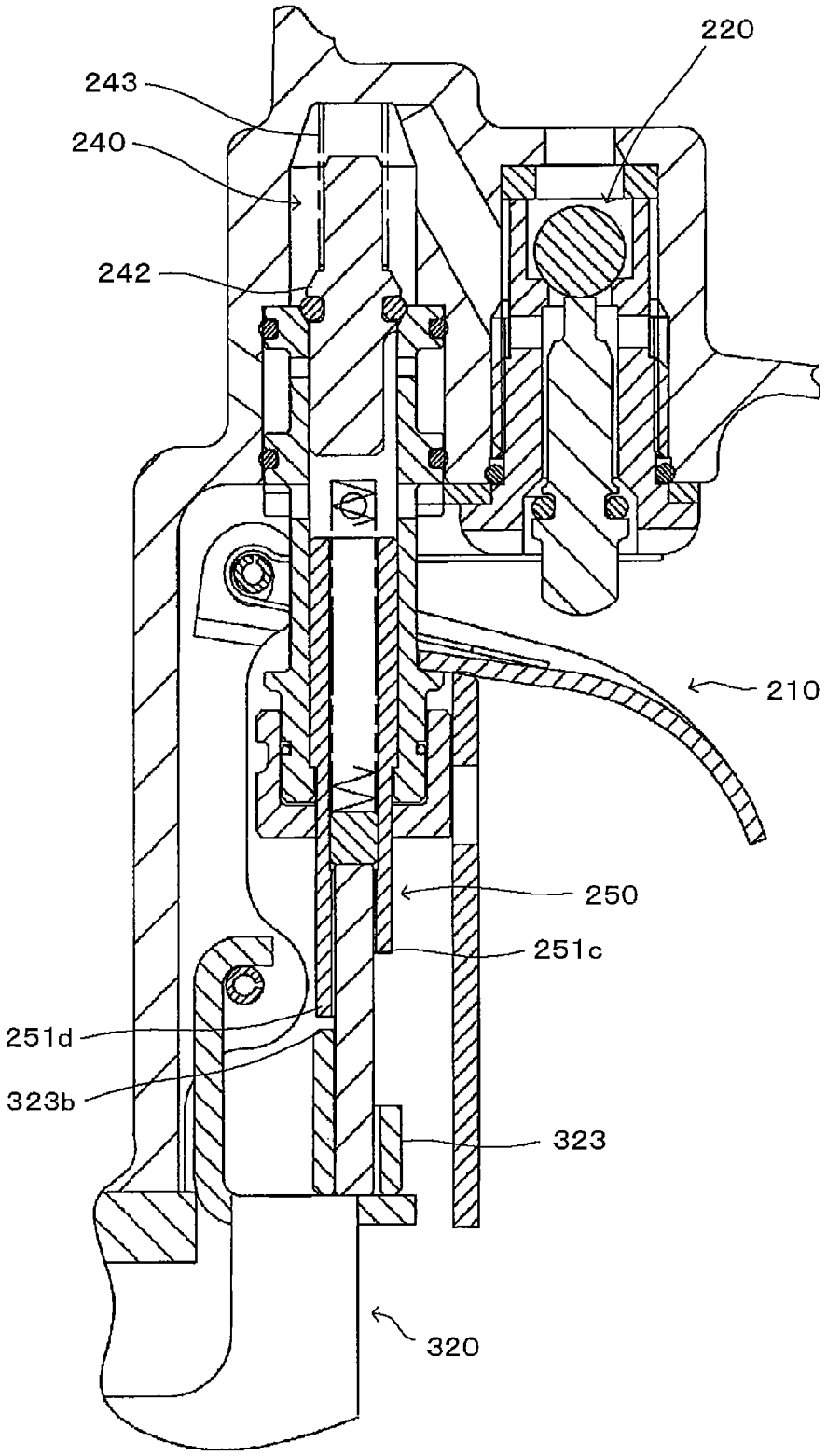
FIG. 10 is a cross-sectional view showing relevant parts of the nail gun in a second operating mode when neither the operation for pulling the trigger nor the operation for pressing the push lever has been performed.
Figure 11:
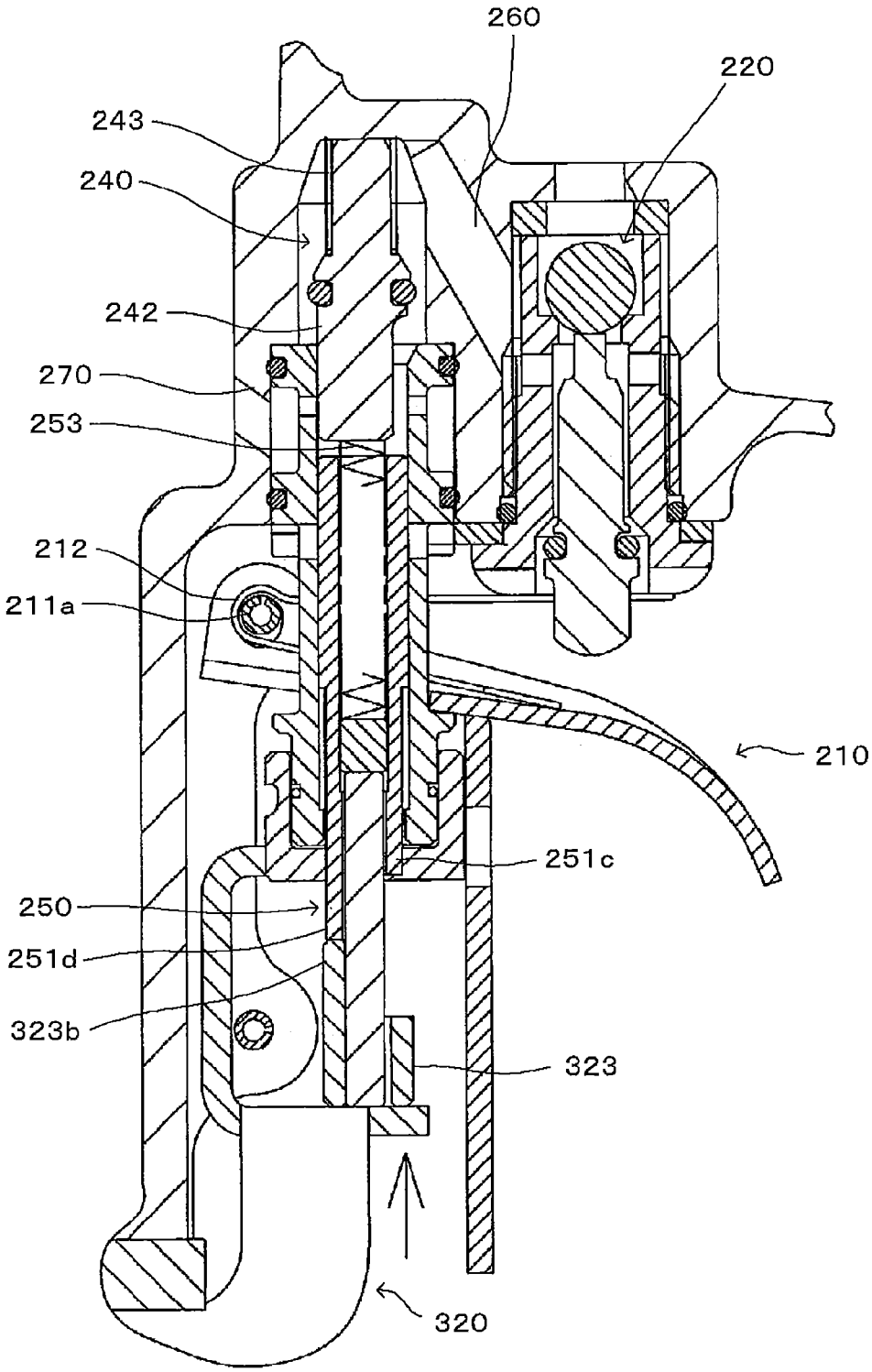
FIG. 11 is a cross-sectional view of the nail gun illustrating changes from the state in FIG. 10 that occur after the push lever is pressed against a workpiece.

Next, the operations of the nail gun 1 according to this embodiment will be described for the second operation. To perform the second operation, the operator sets the nail gun 1 in the second operating mode by rotating the selector knob 254. In the second operating mode, the nail gun 1 is in the state shown in FIG. 10 while the push lever 320 has not been pressed and the trigger 210 has not been pulled. While the nail gun 1 is in this state, the operator presses the bottom end of the push lever 320 against the workpiece 3, moving the push lever 320 to its upper dead center. The push lever plunger unit 250 also moves upward with the push lever 320, and the spring 253 of the push lever plunger unit 250 moves the valve member 242 of the push lever valve 240 upward against the urging force of the spring 243, as shown in FIG. 11. Consequently, the push lever valve 240 is shifted to its open state, allowing communication between the air channel 260 and air channel 270.

Figure 12:
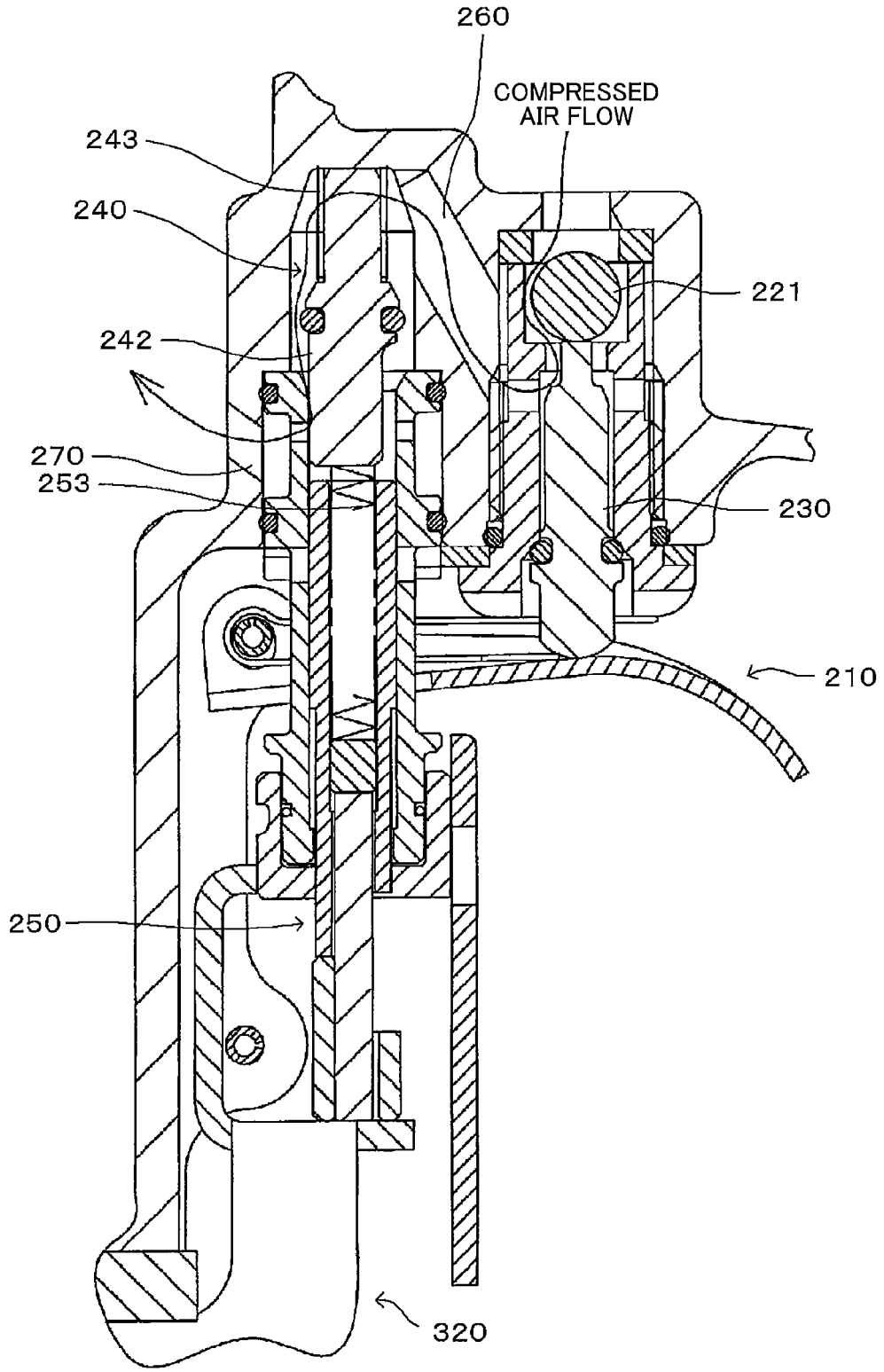
FIG. 12 is a cross-sectional view of the nail gun illustrating changes from the state of FIG. 11 occurring after the trigger is pulled.

Next, the operator pulls the trigger 210 against the urging force of the spring 212. At this time, the trigger 210 rotates counterclockwise in the drawings about the rotational center part 211*a* from the state shown in FIG. 11 to the state shown in FIG. 12. The trigger 210 contacts the bottom end of the trigger plunger 230 and, through the trigger plunger 230, pushes the valve member 221 of the trigger valve 220 upward against the force of compressed air in the trigger valve chamber 223. As a result, the trigger valve 220 shifts into its open state, allowing communication between the accumulating chamber 400 and air channel 260.

Through these operations, the accumulating chamber 400 is now in fluid communication with the main valve chamber 161 through the trigger valve chamber 223, air channel 260, and air channel 270, allowing compressed air in the accumulating chamber 400 to flow into the main valve chamber 161. Hence, the nail gun 1 performs a nail-driving operation for driving a nail 2 into the workpiece 3 according to the same process described above in the first operating mode.

Figure 13:
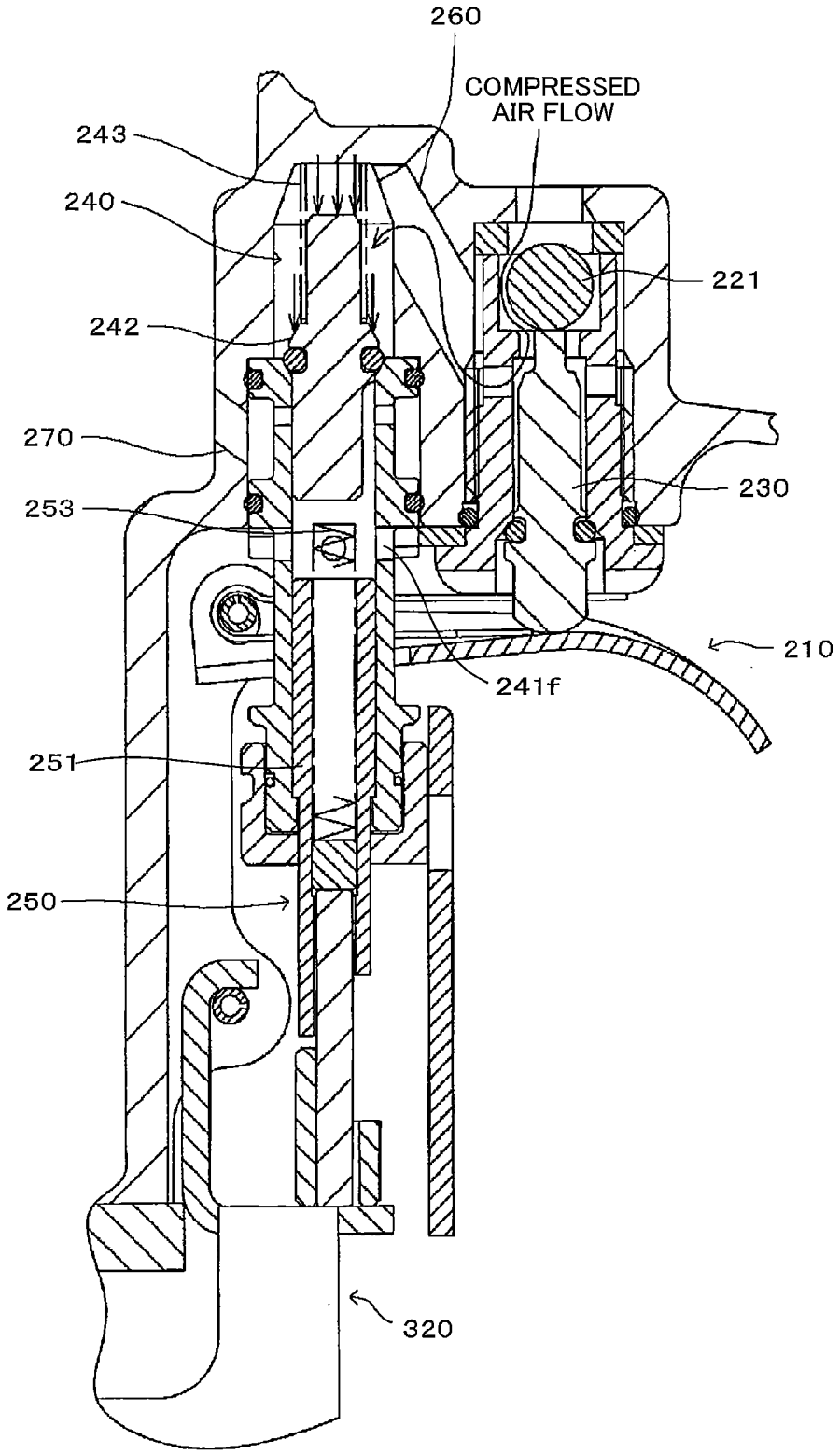
FIG. 13 is a cross-sectional view of the nail gun illustrating changes from the state in FIG. 12 occurring when the push lever is released.

If the operator separates the push lever 320 from the workpiece 3 after the nail-driving operation while continuing to pull the trigger 210, the urging force of the push lever spring 322 moves the push lever 320 downward from the upper dead center, as shown in FIG. 13. At this time, the spring 253 of the push lever plunger unit 250 also moves downward with the push lever 320. Hence, the urging force of the spring 243 provided in the push lever valve 240 moves the valve member 242 downward, thereby shifting the push lever valve 240 into its closed state. Since the plunger 251 moves to its lower dead center at this time, compressed air can escape through the air channel 270 and compressed air outlet 241*f*. The resulting lower air pressure in the main valve chamber 161 allows the cylinder 110 to return to its upper dead center. At the same time, compressed air above the piston 120 is exhausted from the exhaust valve 164, allowing the piston 120 to return to its upper dead center.

If the operator once again presses the push lever 320 against the workpiece 3 while the nail gun 1 is in this state, the push lever plunger unit 250 moves upward with the push lever 320, and the upper end of the plunger 251 contacts the lower end of the valve member 242 constituting the push lever valve 240, as shown in FIG. 14. At this time, the reaction force that the push lever 320 receives from the workpiece 3 is transferred directly and rigidly to the valve member 242 of the push lever valve 240 via the plunger 251 of the push lever plunger unit 250. Hence, the plunger 251 pushes the valve member 242 upward against the force with which the spring 243 of the push lever valve 240 and the compressed air pushes the valve member 242 downward. As a result, the push lever valve 240 shifts into its open state, allowing communication between the air channel 260 and air channel 270 to perform a nail-driving operation.

As described above, in the second operating mode the operator can drive a plurality of nails 2 into a workpiece continuously by repeatedly pushing the push lever 320 against the workpiece 3 while continuing to pull the trigger 210.

In the nail gun 1 according to this embodiment described above, the operator can selectively perform the first operation and second operation by rotating the selector knob 254 to select the first operating mode and second operating mode, respectively. Rotating the selector knob 254 changes the member that pushes the valve member 242 of the push lever valve 240, between the highly rigid plunger 251 and the flexible spring 253. Hence, the nail gun 1 can switch nail-driving operations without requiring a complex structure in the trigger 210.

With the nail gun 1 according to this embodiment, the push lever plunger unit 250 is connected to the push lever 320 via the push lever rod 324, which is capable of moving laterally. Hence, even if the contact part 323 of the push lever 320 is not positioned along the central axis $O_1$ of the through-hole 251*a* (the direction in which the push lever plunger unit 250 moves) due to irregularities and the like occurring when the push lever plunger unit 250 and push lever 320 are assembled, the push lever rod 324 can move laterally to guide the contact part 323 when the push lever 320 is pressed, ensuring that the contact part 323 can reliably transfer an upward force to the push lever plunger unit 250.

While the invention has been described in detail with reference to specific embodiments thereof, it would be apparent to those skilled in the art that many modifications and variations may be made therein without departing from the spirit of the invention, the scope of which is defined by the attached claims.

For example, in this embodiment described above, the part that contacts the protruding part 323*b* of the push lever 320 is changed between the first contact part 251*c* and second contact part 251*d* by rotating the plunger 251, but a different structure for switching this part may be used. For example, the protruding part 323*b* may be configured to be rotatable instead of the plunger 251. Specifically, the plunger 251 may be made non-rotatable inside the through-hole 241*a*, while the contact part 323 is allowed to rotate around the central axis $O_2$ of the through-hole 323*a*. In this case, a square column part similar to the plunger 251 of this embodiment may be formed on the contact part 323, and the nail gun 1 may be provided with a selector knob having a through-hole for receiving this square column part. Also, as in this embodiment, a ratchet spring may be provided for holding the selector knob so that the selector knob is firmly positioned when in the first operating mode and second operating mode. With this construction, the part that contacts the protruding part 323*b* can be changed between the first contact part 251*c* and second contact part 251*d* by rotating the contact part 323.

What is claimed is:

1. A fastener driving tool comprising:

a housing;

a trigger supported to the housing;

a push lever supported to the housing and movable between an upper dead center and a lower dead center in a moving direction, a fastener driving operation being performable when both of a pulling operation for pulling the trigger and a pressing operation for pressing the push lever against a workpiece are executed;

a valve comprising:

a valve member movable in the moving direction; and an engaging part configured to engage the valve member, wherein the valve is in an open state when the valve member is separated from the engaging part, and the valve is in a closed state when the valve member is engaged with the engaging part, a rigid member configured to move the valve member to separate the valve member from the engaging part when the push lever moves from the lower dead center to the upper dead center;

a resilient member configured to provide a resilient force to move the valve member to separate the valve member from the engaging part when the push lever moves from the lower dead center to the upper dead center, the resilient force being changeable in accordance with a movement of the push lever; and a switching part selecting one of the rigid member and the resilient member to move the valve member to separate the valve member from the engaging part, wherein, when the switching part selects the rigid member, the fastener driving operation is performed regardless of an order of the pulling operation and the pressing operation, and, when the switching part selects the resilient member, the fastener driving operation is performed only when the pulling operation is executed after the pressing operation is executed.

2. The fastener driving tool as claimed in claim 1, further comprising a connecting part movable in a direction orthogonal to the moving direction, and wherein the rigid member and the resilient member are associated with the push lever through the connecting part.

3. The fastener driving tool as claimed in claim 2, wherein the rigid member is formed in a tubular shape with a first through-hole extending in the moving direction, wherein the resilient member is provided in the first through-hole, wherein the push lever has a tubular shape with a second through-hole extending in the moving direction, and wherein the connecting part has a rod, one end of the rod being positioned within the first through-hole, the other end of the rod being positioned within the second through-hole.

* * * * *